US011141833B1

(12) United States Patent
Kingsbury

(10) Patent No.: US 11,141,833 B1
(45) Date of Patent: Oct. 12, 2021

(54) ABRASIVE MEDIA DISPENSING APPARATUS FOR USE WITH AN EXCAVATOR

(71) Applicant: Richard Allen Kingsbury, Boulder Creek, CA (US)

(72) Inventor: Richard Allen Kingsbury, Boulder Creek, CA (US)

( * ) Notice: Subject to any disclaimer, the term of this patent is extended or adjusted under 35 U.S.C. 154(b) by 732 days.

(21) Appl. No.: 16/100,418

(22) Filed: Aug. 10, 2018

Related U.S. Application Data

(60) Provisional application No. 62/543,586, filed on Aug. 10, 2017.

(51) Int. Cl.

| | |
|---|---|
| ***B24C 3/02*** | (2006.01) |
| ***B24C 3/06*** | (2006.01) |
| ***B24C 5/04*** | (2006.01) |
| ***E02F 3/90*** | (2006.01) |
| ***B24C 7/00*** | (2006.01) |
| ***E02F 3/96*** | (2006.01) |
| ***E02F 5/28*** | (2006.01) |

(52) U.S. Cl.
CPC ..... *B24C 3/02* (2013.01); *B24C 3/06* (2013.01); *B24C 5/04* (2013.01); *B24C 7/0053* (2013.01); *E02F 3/907* (2013.01); *E02F 3/962* (2013.01); *E02F 5/287* (2013.01)

(58) Field of Classification Search
CPC .. B24C 3/02; B24C 3/06; B24C 3/062; B24C 5/04; B24C 7/0046; B24C 7/0053; E02F 3/962; E02F 5/287
USPC ..... 451/2, 38, 39, 40, 75, 90, 92
See application file for complete search history.

(56) References Cited

U.S. PATENT DOCUMENTS

| | | | | |
|---|---|---|---|---|
| 3,908,314 | A * | 9/1975 | Watanabe | B24C 3/065 451/92 |
| 4,027,433 | A * | 6/1977 | Hockett | B24C 3/00 451/75 |
| 4,719,975 | A * | 1/1988 | LaBounty | B23D 17/06 173/46 |
| 5,775,979 | A * | 7/1998 | Coke | B24C 3/065 451/354 |
| 2009/0151204 | A1* | 6/2009 | Thomas | E02F 3/40 37/403 |
| 2014/0259597 | A1* | 9/2014 | Lavalley | F16L 1/036 29/407.1 |
| 2017/0022684 | A1* | 1/2017 | Simpson | A01G 3/08 |

(Continued)

*Primary Examiner* — Eileen P Morgan
(74) *Attorney, Agent, or Firm* — Plager Schack LLP; Mark H. Plager; Kara Verryt

(57) ABSTRACT

An omnidirectional blast media dispensing apparatus mounted to an excavator and designed to dispense abrasive media from a blast pot is provided. The apparatus adjusts directional flow of the abrasive media exiting the apparatus to contact a desired target. The apparatus includes a housing coupled to the boom of the excavator, a hydraulic motor assembly coupled to the housing and operably connected to hydraulic lines of the excavator, and a main tubular member rotatably mounted to the housing and operably connected to the hydraulic motor assembly. The first end of the main tubular member is coupled to the blast pot and a nozzle is coupled to the second end of the main tubular member. Fluid flows from the hydraulic lines of the excavator to the hydraulic motor assembly to enable the hydraulic motor assembly to rotatably adjust the main tubular member to direct the nozzle toward the target.

10 Claims, 3 Drawing Sheets

(56) References Cited

U.S. PATENT DOCUMENTS

| | | | | |
|---|---|---|---|---|
| 2018/0171577 | A1* | 6/2018 | Peter | E02F 3/962 |
| 2019/0360180 | A1* | 11/2019 | Carpenter | E02F 3/3677 |
| 2020/0263396 | A1* | 8/2020 | Clarke | B66C 23/54 |

* cited by examiner

ABRASIVE MEDIA DISPENSING APPARATUS FOR USE WITH AN EXCAVATOR

RELATED APPLICATION

The application claims priority to provisional patent application U.S. Ser. No. 62/543,586 filed on Aug. 10, 2017, the entire contents of which is herein incorporated by reference.

BACKGROUND

The embodiments herein relate generally to blast media and devices for dispensing abrasive media. More specifically, embodiments of the invention are directed to an abrasive media dispensing apparatus for use with an excavator.

Abrasive media such as fine pieces of glass, steel, aluminum oxide, plastic, silicon carbide, stones, sand, shells or other materials are often used during abrasive blasting to remove paint, corrosion and rust from hard surfaces. Abrasive blasting techniques require machinery to project the abrasive media at a high velocity across the hard surface that is being treated. Currently, a human operator of media blasting equipment is required to manually support a heavy hose that is connected to a blast pot and air compressor. The blast pot is a receptacle that houses the abrasive media. The air compressor is activated to generate sufficient air pressure to permit the abrasive media to flow from the blast pot through the hose and toward the desired target.

The manual operation of the blast hose is disadvantageous because significant energy is required by the human operator to maneuver the heavy hose. In addition, the high-pressure flow of abrasive media through the hose pushes back on the operator, which makes it difficult for the operator to hold the hose in a steady manner while directing the flow of abrasive media toward the target. This leads quickly to human fatigue and the inefficient operation of abrasive blasting procedures. Further, the reach of the fired abrasive media under these circumstances is greatly limited by the reach of the human operator. Therefore, this manual operation of abrasive blasting is not practical in situations where the target to be blasted is positioned at a height such as 20 feet or greater above the ground.

As such, there is a need in the industry for an omnidirectional blast media dispensing apparatus for use with an excavator that addresses the limitations of the prior art, which greatly reduces user fatigue and enhances the overall distance the blasted abrasive media can travel.

SUMMARY

An omnidirectional blast media dispensing apparatus mounted to a boom of an excavator and operably connected to existing hydraulic lines of the excavator is provided. The apparatus is configured to dispense abrasive media from a blast pot operably connected to a compressor. The apparatus is configured to adjust directional flow of the abrasive media exiting the apparatus to contact a desired target. The blast media dispensing apparatus comprises a housing coupled to the boom of the excavator and comprising a front face, a rear face opposite the front face and a bottom face connecting the front and rear faces together to form an interior cavity, the housing comprising a longitudinal axis oriented generally parallel to the front and rear faces, a hydraulic motor assembly coupled to the housing and operably connected to the hydraulic lines of the excavator, a main tubular member rotatably mounted to the housing and operably connected to the hydraulic motor assembly, the main tubular member oriented generally perpendicular to the longitudinal axis of the housing and extending entirely through the housing to permit both a first end and a second end of the main tubular member to remain outside the housing, the first end of the main tubular member coupled to the blast pot, and a nozzle coupled to the second end of the main tubular member, wherein fluid flows from the hydraulic lines of the excavator to the hydraulic motor assembly to enable the hydraulic motor assembly to rotatably adjust the main tubular member to direct the nozzle toward the target, thereby permitting abrasive media from the blast pot to pass through the main tubular member and out the nozzle to contact the target.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
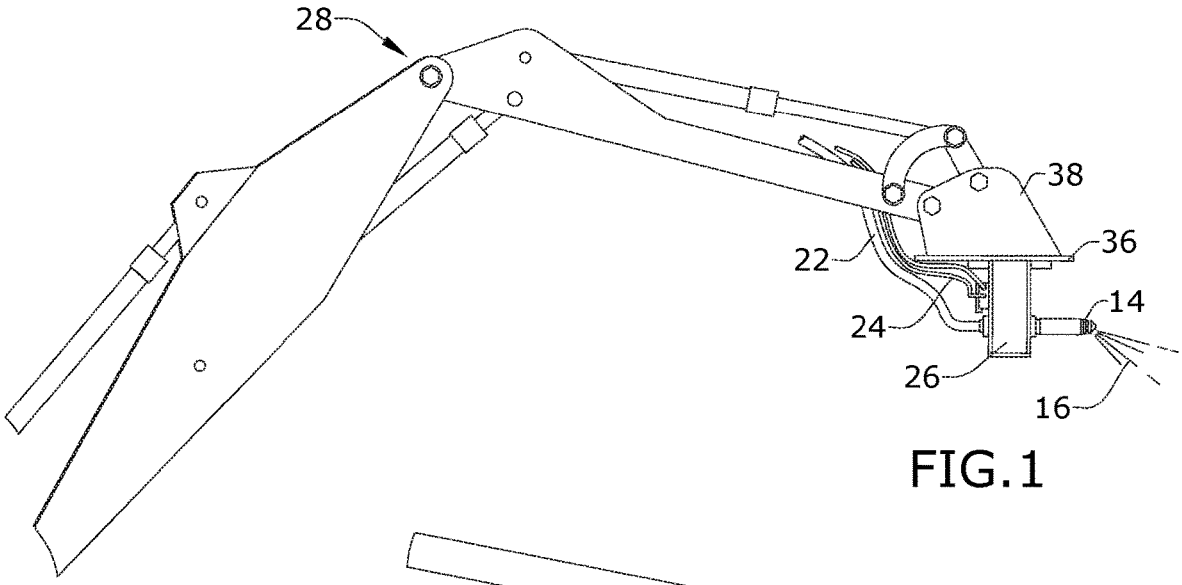
FIG. 1 depicts a side view of certain embodiments of the blast media dispensing apparatus shown in use.

As depicted in FIGS. 1-2 and 5-6, the blast media dispensing apparatus is configured to mount to boom 28 of excavator 11 and dispense blast media 16 toward a desired target. In a preferred embodiment, the blast media dispensing apparatus is operably connected to the existing hydraulic lines of excavator 11 and a blast pot as is known in the field. The blast pot is a receptacle configured to store blast media 16, which may be any abrasive media including, but not limited to, fine pieces of glass, steel, aluminum oxide, plastic, silicon carbide, stones, sand, shells or other materials.

In certain embodiments of the invention, the blast media dispensing apparatus generally comprises housing 26, nozzle 14, main tubular member 18, hydraulic motor assembly 20 and hose 22. The components of the blast media dispensing apparatus may be made from materials including but not limited to, steel, other metals or materials.

As depicted in FIGS. 1-2 and 4-6, housing 26 is a compartment with an internal cavity coupled to boom 28 of excavator 11. Housing 26 can be mounted to excavator 11 by using a series of mounting plates, brackets and mechanical fasteners. In a preferred embodiment, attachment plates 25, horizontal stabilizing plate 36, vertical connecting plates 38 and bolts 40 are used to couple housing 26 to boom 28 of excavator 11.

Figure 5:
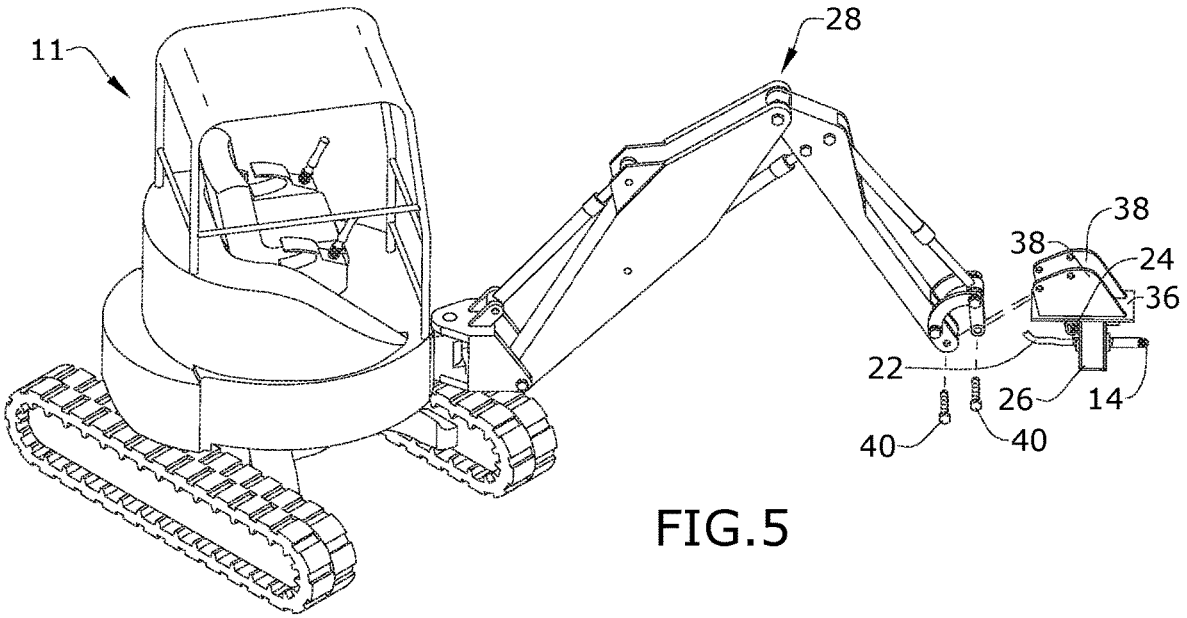
FIG. 5 depicts an exploded view of certain embodiments of the blast media dispensing apparatus.
Figure 6:
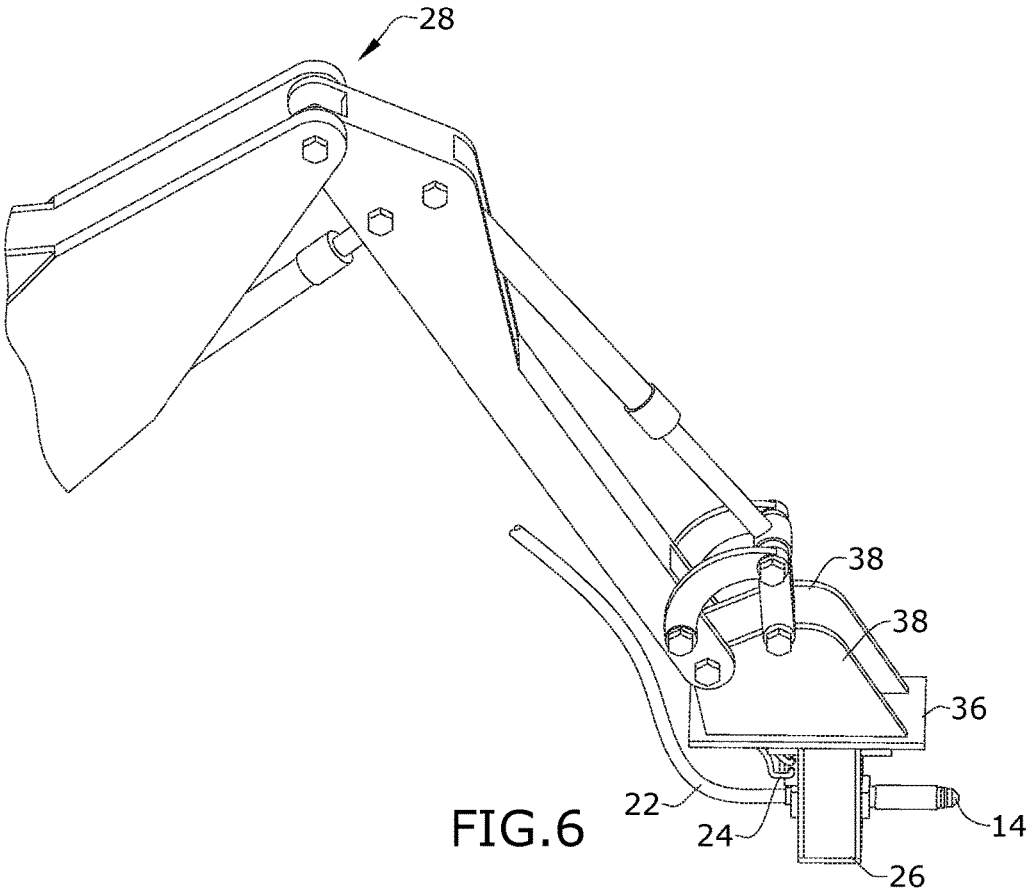
FIG. 6 depicts a perspective view of certain embodiments of the blast media dispensing apparatus.

In one embodiment, the top portion of housing 26 is coupled to attachment plates 25 by screws or other mechanical fasteners such as bolts, nuts, and the like. Alternatively, housing 26 can be welded to attachment plates 25. Attachment plates 25 are coupled to the bottom surface of horizontal stabilizing plate 36 by mechanical fasteners such as screws, bolts and/or nuts. A pair of vertical connecting plates 38 are welded to the top surface of horizontal stabilizing plate 36. As depicted in FIGS. 5-6, vertical connecting plates 38 are coupled to the end of boom 28 of excavator 11 using bolts 40.

Figure 2:
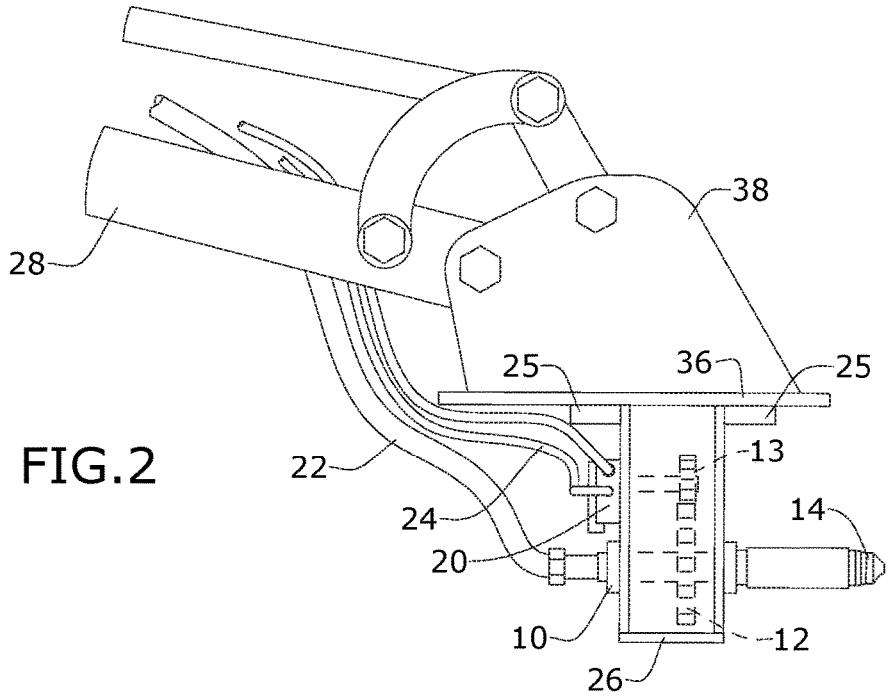
FIG. 2 depicts a side cutaway view of certain embodiments of the blast media dispensing apparatus.
Figure 3:
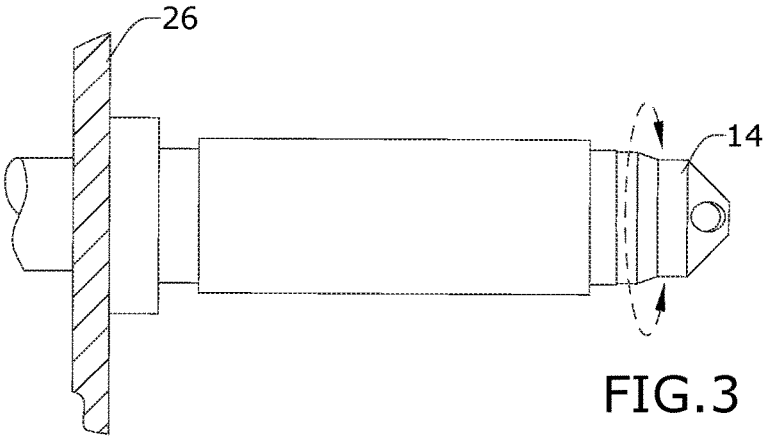
FIG. 3 depicts a side view of certain embodiments of the blast media dispensing apparatus illustrating the rotation of nozzle 14.
Figure 4:
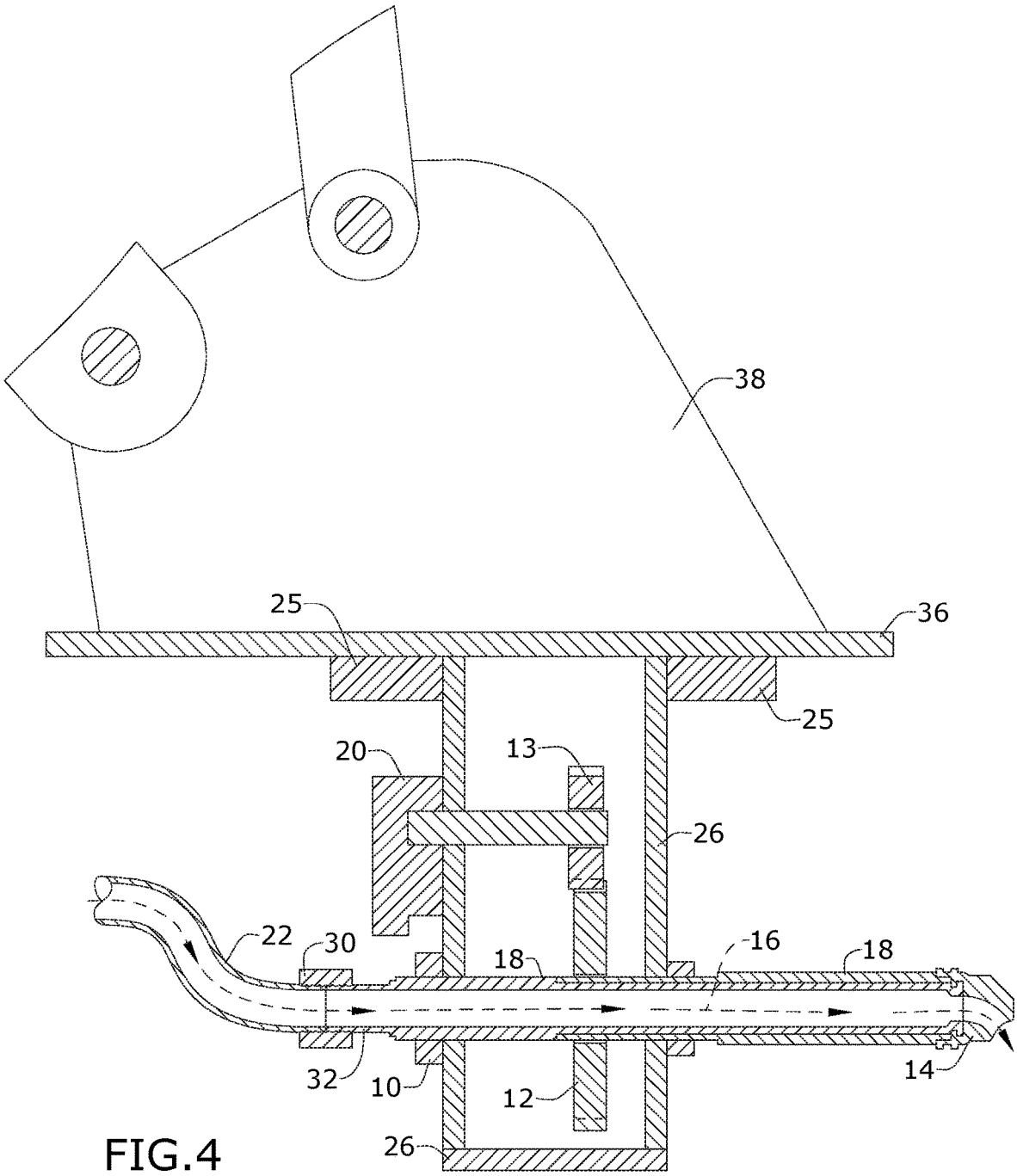
FIG. 4 depicts a section view of certain embodiments of the blast media dispensing apparatus.

As depicted in FIGS. 1-2 and 4, hydraulic motor assembly 20 is coupled to housing 26 and preferably comprises a rotatable drive gear 13 and shaft that extends within the interior cavity of housing 26. In one embodiment, hydraulic motor assembly 20 comprises a rating of approximately ¼-⅛ horsepower. However, hydraulic motor assembly 20 may have variable specifications. Hydraulic motor assembly 20 is operably connected to the existing hydraulic pressure, drive and control systems of excavator 11.

In one embodiment, hydraulic lines 24 of hydraulic motor assembly 20 are operably connected to existing hydraulic lines of excavator 11, which are part of the auxiliary circuit typically designated for use to power the thumb of the excavator. As such, the operator of excavator 11 can control the flow of hydraulic fluid into hydraulic motor assembly 20 via hydraulic lines 24 by maneuvering the joystick and/or toggle switches in the cab of excavator 11. This permits hydraulic motor assembly 20 to rotate drive gear 13 clockwise or counterclockwise.

Main tubular member 18 is rotatably mounted to housing 26. In one embodiment, main tubular member 18 extends entirely through housing 26 and is oriented generally perpendicular to a longitudinal axis of housing 26. Driven gear 12 is coupled to an intermediate outer portion of main tubular member 18 and is engaged with drive gear 13 of hydraulic motor assembly 20. In this connection, drive gear 13 of hydraulic motor assembly 20 drives driven gear 12 to rotate main tubular member 18 clockwise or counterclockwise as desired.

The ends of main tubular member 18 extend outside of housing 26 on opposite sides of the housing. A pair of bearing blocks 10 is coupled to housing 26 and operably connected to main tubular member 18. More specifically, a first bearing block is coupled to the rear face of housing 26 and is operably connected to main tubular member 18. A second bearing block is coupled to the front face of housing 26 and is operably connected to main tubular member 18. Bearing blocks 10 comprise bearing components that permit the free rotation of main tubular member 18 in both the clockwise and counterclockwise directions. Bearing blocks 10 also prevent longitudinal movement of main tubular member 18 to maintain the alignment and engagement of drive gear 13 with driven gear 12.

In one embodiment, main tubular member 18 comprises an interior diameter within the approximate range of ½"-1". However, main tubular member 18 may have variable dimensions. It shall be appreciated that main tubular member 18 may comprise a single tubular member or multiple tubular members and/or sleeves coupled together.

The first end of main tubular member 18 is coupled to the blast pot by hose 22, coupling 30 and swivel joint 32. Hose 22 may comprise variable lengths. In one embodiment, hose 22 is approximately 100' in length. The first end of hose 22 is coupled to the blast pot. The blast pot may be located in any location proximate excavator 11 or mounted to excavator 11.

The second end of hose 22 is coupled to swivel joint 32 by coupler 30. In a preferred embodiment, coupler 30 is coupled to adjacent ends of hose 22 and swivel joint 32 via threaded connections. In one embodiment, additional fasteners such as screws may be used to enhance the connection between coupler 30 and hose 22. The first end of main tubular member 18 is coupled to the remaining end of swivel joint 32. Swivel joint 32 is preferably a high-pressure swivel joint such as a Rotaflow F-Series swivel joint or other similar-type swivel joint. Swivel joint 32 permits the free rotation of main tubular member 18 in both the clockwise and counterclockwise directions and prevents rotation of hose 22.

Nozzle 14 is coupled to the second end of main tubular member 18. In one embodiment, nozzle 14 is coupled to main tubular member 18 by a threaded connection. However, alternative connections and/or fasteners may be used to secure the components together. Nozzle 14 preferably comprises an inner pathway with a curvature. In one embodiment, the outlet of nozzle 14 comprises a central axis that is oriented approximately 45 degrees relative to a longitudinal axis of main tubular member 18. However, the angle formed by the central axis of nozzle 14 and the longitudinal axis of main tubular member 18 may vary. In one embodiment, the outlet of nozzle 14 comprises an approximate diameter of 7⁄16"-¾". In one embodiment, the outlet of nozzle 14 comprises an approximate diameter of 0-⅞".

In operation, the blast media dispensing apparatus is mounted to excavator 11 as previously described. The blast pot is operably connected to an air compressor that is configured to generate sufficient air pressure to permit the abrasive media to flow from the blast pot through hose 22, main tubular member 18 and out nozzle 14 toward the desired target.

The operator of excavator 11 uses the conventional controls in the cab of the excavator to raise or lower boom 28 to a desired position. The operator uses the joystick and/or toggle switches in the excavator's cab to control the hydraulic fluid that flows through hydraulic lines 24 to hydraulic motor assembly 20. This permits drive gear 13 of hydraulic motor assembly 20 to drive driven gear 12, thereby rotating main tubular member 18 as desired. This allows the operator to rotate nozzle 14 up to 360 degrees so that the path of blast media 16 exiting the outlet of nozzle 14 is directed toward the intended target.

The blast media dispensing apparatus is advantageous because it greatly enhances the efficiency of abrasive blasting procedures and reduces user fatigue by using the hydraulic pressure, drive and control systems of excavator 11. By altering the size of excavator 11, the blast media dispensing apparatus can be used in a wide range of applications to complete abrasive blasting procedures that require the blast media to travel greater distances to the intended target.

It shall be appreciated that the components of the blast media dispensing apparatus described in several embodiments herein may comprise any alternative known materials in the field and be of any color, size and/or dimensions. It shall be appreciated that the components of the blast media dispensing apparatus described herein may be manufactured and assembled using any known techniques in the field. Although the blast media dispensing apparatus has been described for use with a hydraulic system, modifications can be made to the apparatus to permit it to operate with other pneumatic systems or actuating systems.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. An omnidirectional blast media dispensing apparatus mounted to a boom of an excavator and operably connected to existing hydraulic lines of the excavator, the apparatus configured to dispense abrasive media from a blast pot operably connected to a compressor, the apparatus configured to adjust directional flow of the abrasive media exiting the apparatus to contact a desired target, the blast media dispensing apparatus comprising:

a housing coupled to the boom of the excavator and comprising a front face, a rear face opposite the front face and a bottom face connecting the front and rear faces together to form an interior cavity, the housing comprising a longitudinal axis oriented generally parallel to the front and rear faces;

a hydraulic motor assembly coupled to the housing and operably connected to the hydraulic lines of the excavator;

a main tubular member rotatably mounted to the housing and operably connected to the hydraulic motor assembly, the main tubular member oriented generally perpendicular to the longitudinal axis of the housing and extending entirely through the housing to permit both a first end and a second end of the main tubular member to remain outside the housing, the first end of the main tubular member coupled to the blast pot; and a nozzle coupled to the second end of the main tubular member;

wherein fluid flows from the hydraulic lines of the excavator to the hydraulic motor assembly to enable the hydraulic motor assembly to rotatably adjust the main tubular member to direct the nozzle toward the target, thereby permitting abrasive media from the blast pot to pass through the main tubular member and out the nozzle to contact the target.

2. The blast media dispensing apparatus of claim 1, further comprising a driven gear coupled to the main tubular member and positioned within the interior cavity of the housing.

3. The blast media dispensing apparatus of claim 2, wherein the hydraulic motor assembly comprises secondary hydraulic lines coupled to the existing hydraulic lines of the excavator and a rotatable drive gear engaged with the driven gear.

4. The blast media dispensing apparatus of claim 3, comprising a first bearing block coupled to the rear face of the housing and operably connected to the main tubular member and a second bearing block coupled to the front face of the housing and operably connected to the main tubular member.

5. The blast media dispensing apparatus of claim 4, wherein the main tubular member comprises a longitudinal axis and the nozzle comprises an outlet with a central axis, the longitudinal axis of the main tubular member oriented approximately 45 degrees relative to the central axis of the nozzle.

6. The blast media dispensing apparatus of claim 5, further comprising a hose comprising a first end coupled to the blast pot and a second end coupled to the first end of the main tubular member.

7. The blast media dispensing apparatus of claim 6, further comprising a swivel joint connecting the second end of the hose to the first end of the main tubular member.

8. The blast media dispensing apparatus of claim 7, further comprising a coupler connecting the second end of the hose to the swivel joint.

9. The blast media dispensing apparatus of claim 8, wherein the drive gear of the hydraulic motor assembly is configured to drive the driven gear on the main tubular member to permit the nozzle to rotate within the approximate range of 0 to 360 degrees.

10. The blast media dispensing apparatus of claim 9, wherein the outlet of the nozzle comprises an approximate diameter of 7/16"-3/4".

* * * * *